US006944898B2

(12) United States Patent
Matthews Brown et al.

(10) Patent No.: US 6,944,898 B2
(45) Date of Patent: Sep. 20, 2005

(54) MULTI-USE PILLOW AND METHODS

(75) Inventors: Susan H. Matthews Brown, Evergreen, CO (US); Sheila Littlehorn, Littleton, CO (US); Elizabeth A. Franqui, Golden, CO (US)

(73) Assignee: The Boppy Company, Golden, CO (US)

( * ) Notice: Subject to any disclaimer, the term of this patent is extended or adjusted under 35 U.S.C. 154(b) by 72 days.

(21) Appl. No.: 10/612,266

(22) Filed: Jul. 1, 2003

(65) Prior Publication Data

US 2005/0005359 A1 Jan. 13, 2005

(51) Int. Cl.[7] ..... A47G 9/00
(52) U.S. Cl. ..... 5/655; 5/652; 5/632
(58) Field of Search ..... 5/655, 644, 636, 5/490, 653, 654, 655.3, 632, 652; D6/601

(56) References Cited

U.S. PATENT DOCUMENTS

| | | | | |
|---|---|---|---|---|
| 682,871 | A | 9/1901 | Hogan et al. | |
| 1,343,357 | A | 6/1920 | Eggers | |
| 2,328,871 | A | 9/1943 | Woehler | |
| 2,961,668 | A | 11/1960 | Hayes | |
| 3,667,074 | A | 6/1972 | Emery | |
| 3,848,281 | A | 11/1974 | Mathews | |
| 3,911,512 | A | * 10/1975 | Plate | 5/652 |
| 3,920,239 | A | 11/1975 | White | |
| 4,161,794 | A | 7/1979 | Darnfors | |
| 4,197,604 | A | 4/1980 | Nakamura | |
| D255,966 | S | 7/1980 | Stadel | |
| 4,227,270 | A | 10/1980 | Rivera | |
| 4,236,264 | A | 12/1980 | Britzman | |
| 4,345,347 | A | 8/1982 | Kantor | |
| 4,434,513 | A | 3/1984 | Welch | |
| 4,731,890 | A | 3/1988 | Roberts | |
| 4,858,259 | A | 8/1989 | Simmons et al. | |

(Continued)

FOREIGN PATENT DOCUMENTS

| | | |
|---|---|---|
| DE | 42 05 650 A1 | 11/1993 |
| EP | 1 306 034 A1 | 5/2003 |
| FR | 1.430.355 | 1/1966 |
| FR | 2 379 268 | 9/1978 |
| GB | 215848 | 5/1924 |
| GB | 1 508 809 | 4/1978 |
| GB | 2 198 341 A | 6/1988 |
| GB | 2 205 236 A | 12/1988 |
| WO | WO 02/21978 A2 | 3/2002 |
| WO | WO 02/21979 A1 | 3/2002 |
| WO | WO 02/28232 A1 | 4/2002 |

*Primary Examiner*—Robert G. Santos
(74) *Attorney, Agent, or Firm*—Townsend and Townsend and Crew LLP

(57) ABSTRACT

A pillow comprises a pillow body having a midsection and a pair of ends. The pillow body is curved with an average radius of curvature in the range from about 6 inches to about 16 inches. The pillow also has a length from one end to the other that is in the range from about 21 inches to about 42 inches. The pillow is both flexible and firm to permit it to wrap around a user.

23 Claims, 2 Drawing Sheets

U.S. PATENT DOCUMENTS 5,029,350 A 7/1991 Edelson
5,056,533 A 10/1991 Solano
5,134,740 A 8/1992 Summer
5,154,649 A 10/1992 Pender
5,193,235 A 3/1993 Kircher
5,257,429 A 11/1993 Genis
5,261,134 A 11/1993 Mathews
5,313,678 A 5/1994 Redewill
D348,174 S 6/1994 Genis
D352,633 S 11/1994 Berggren
D360,554 S 7/1995 Righini
5,519,906 A 5/1996 Fanto-Chan
5,546,620 A 8/1996 Mathews
5,581,833 A 12/1996 Zenoff
D377,881 S 2/1997 Watt
5,661,861 A 9/1997 Mathews
5,702,153 A 12/1997 Pliska
D393,772 S 4/1998 Vingino
5,790,999 A 8/1998 Clark
D416,159 S 11/1999 Porter
5,979,981 A 11/1999 Dunne et al.
6,038,720 A 3/2000 Mathews et al.
6,052,848 A 4/2000 Kelly
6,055,687 A 5/2000 Mathews
6,233,767 B1 5/2001 Horowitz
6,279,185 B1 8/2001 Mathews
6,321,403 B1 11/2001 Matthews
6,354,665 B1 3/2002 Ross
6,412,128 B1 7/2002 Mathews
6,434,770 B2 8/2002 Mathews Brown
6,453,493 B1 9/2002 Mathews Brown
6,463,608 B1 * 10/2002 Moe ..... 5/646
6,484,337 B1 * 11/2002 Moe et al. ..... 5/652
6,487,737 B1 12/2002 Futagami
6,523,200 B2 2/2003 Brown
6,532,612 B2 3/2003 Mathews Brown
6,625,828 B2 9/2003 Matthews Brown
6,640,977 B2 * 11/2003 Matthews
Brown et al. ..... 206/770
6,651,282 B1 * 11/2003 Skoug et al. ..... 5/655
6,658,681 B2 * 12/2003 Britto et al. ..... 5/655
6,671,908 B2 * 1/2004 Brown et al. ..... 5/644
6,685,024 B1 * 2/2004 Matthews ..... 206/521
6,763,539 B1 * 7/2004 Bartley et al. ..... 5/655
6,779,211 B1 * 8/2004 Williams ..... 5/655
6,810,545 B1 * 11/2004 Darling et al. ..... 5/655
2002/0014436 A1 2/2002 Mathews Brown
2002/0029422 A1 * 3/2002 Matthews ..... 5/655
2004/0060116 A1 * 4/2004 Matthews Brown ..... 5/636
2004/0154104 A1 * 8/2004 Brown et al. ..... 5/644
2004/0200004 A1 * 10/2004 Brown et al. ..... 5/655

* cited by examiner

MULTI-USE PILLOW AND METHODS

BACKGROUND OF THE INVENTION

This invention relates generally to the field of pillows, and in particular to pillows that may be used to support various items. More specifically, the invention relates to pillows that may rest on a user's lap to help support the items.

Pillows have a wide variety of uses. For example, pillows are used almost universally when sleeping to support the head. Pillows may also be used to support other things as well. One example of such a pillow is the Boppy® support pillow, commercially available from The Boppy Company. Examples of such pillows are also described in U.S. Pat. Nos. 5,261,134 and 5,661,861, the complete disclosures of which are herein incorporated by reference. One use for these pillows is to use the open well to support a baby or to be placed around a user.

This invention relates to other pillows having a wide variety of uses. These pillows are described more fully hereinafter.

BRIEF SUMMARY OF THE INVENTION

In one embodiment, the invention provides a pillow that comprises a pillow body having a midsection and a pair of ends. The pillow body is curved and has an average radius of curvature that is in the range from about 6 inches to about 16 inches. The pillow also has a length in the range from about 21 inches to about 42 inches. The pillow body is firm enough to support items while being sufficiently flexible to allow the pillow to be shaped around an object, such as the waist or stomach of a user.

The pillow may be used by placing the pillow on a user's lap. In so doing, the midsection may rest on the user's legs while being adjacent to the user's stomach. The curved pillow body permits the pillow to wrap about the user so that the ends are adjacent the user's sides. The radius of curvature is selected so that the pillow may conform to a wide variety of users of different sizes. By selecting an appropriate radius of curvature, the ends are spaced sufficiently far apart so that the pillow can fit around the user while also closely conforming to the user.

The pillow body may be constructed in a variety of says. For example, the pillow body may comprise a fill material that is encased in a fabric cover. As another example, the pillow body may comprise an inflatable bladder. In one aspect, the pillow may also have a removable slip cover. The slip cover may have an opening to permit it to be placed over the pillow. A fastener, such as a zipper, may be used to close the opening.

In one aspect, the midsection of the pillow body may have an average width that is in the range from about 5 inches to about 10 inches, and an average height in the range from about 4 inches to about 9 inches. The ends may be rounded and may have an average width in the range from about 3 inches to about 10 inches and an average height in the range from about 1 inch to about 9 inches. The ends may also be spaced apart by a distance in the range from about 14 inches to about 28 inches.

One advantage of the pillow is that the ends may be manipulated so that they fit between the arms of a chair and the user's sides. In this way, the pillow may conveniently be used when sitting in a chair.

The pillow may also be used to support a variety of items. For example, the pillow may be used to hold a baby, such as when nursing or bottle feeding the baby, or simply to help hold the baby. Other examples include the holding of books, food, crafts and the like.

DETAILED DESCRIPTION OF THE INVENTION

In one aspect, the pillows of the invention comprise a pillow body that is gently curved. The amount of curvature is selected so that the ends of the pillow are spaced enough apart to permit the pillow to be placed around individuals having a variety of sizes. The amount of curvature may be defined in terms of an "average" radius of curvature. This dimension represents the radius that is generated if an arc is drawn between a center point of the pillow body and the two ends. Because the pillow may not be fashioned according to a true geometric arc, the term "average" is used to indicate it is merely an approximation. Hence, the pillow bodies may be curved according to a true arc or other type of geometric curvature. Further, the pillow bodies may have a wide variety of shapes and other design features including rounded or curved edges or ends, tapered sides or ends, patterned edges, sloping or curved sections and the like.

Figure 1:
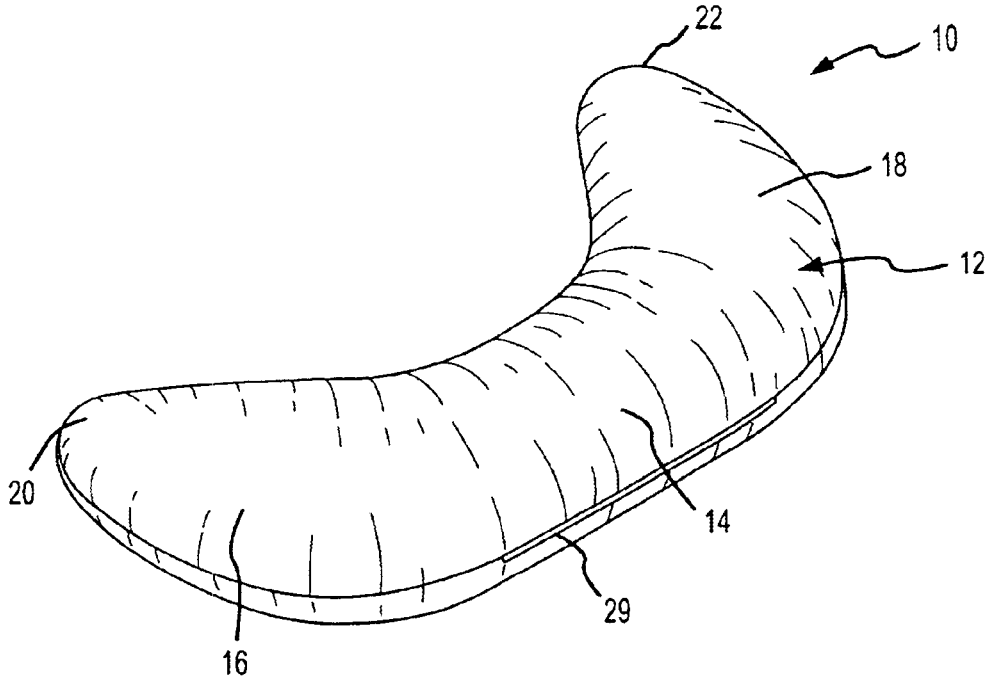
FIG. 1 is a front perspective view of an embodiment of a pillow according to the invention.
Figure 2:
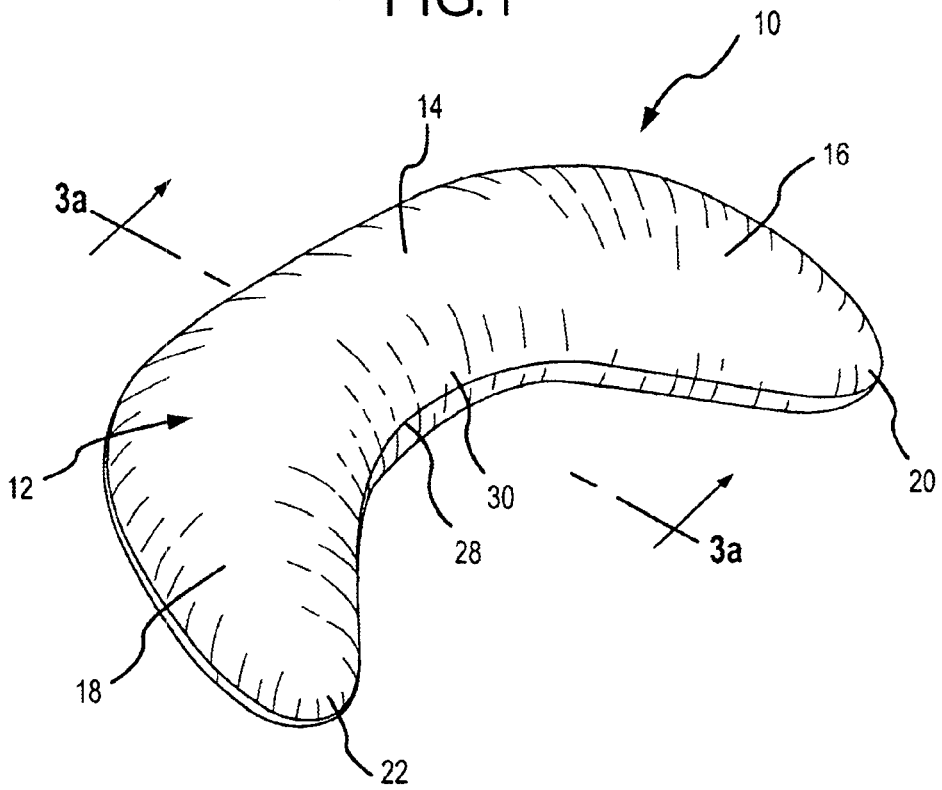
FIG. 2 is a rear perspective view of the pillow of FIG. 1
Figure 3A:
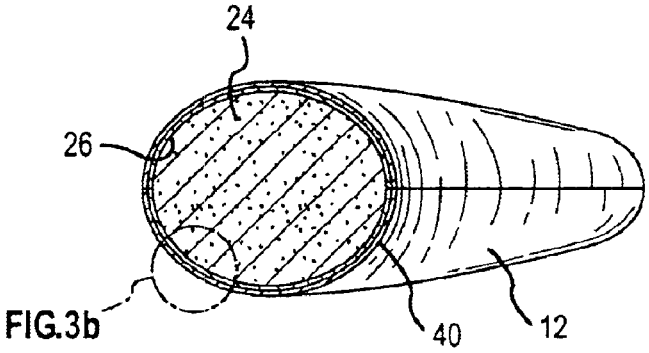
FIG. 3*a* is a cross sectional side view of the pillow of FIG. 1 with a removable slip cover.
Figure 3B:
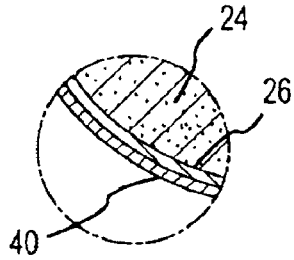
FIG. 3*b* is a more detailed view of the pillow of FIG. 3*a*.

Referring now to FIGS. 1 and 2, one embodiment of a pillow 10 will be described. Pillow 10 comprises a pillow body 12 having a midsection 14 and two end sections 16 and 18 that terminate in ends 20 and 22. As best shown in FIGS. 3*a* and 3*b*, pillow 10 maybe constructed of a fill material 24 that is covered by a fabric cover 26. Examples of fill materials that may be used include resilient, compression resistant, hypoallergenic material, such as polyester fibers, and the like. Cover 26 may be any type of fabric such as cotton, nylon, LYCRA, denim, polyester and the like. Pillow body 12 may conveniently be constructed by sewing together two pieces of fabric along a center seam 28. The fill material 24 may be stuffed inside cover 26 to provide sufficient firmness so that pillow 10 generally does not sag or droop when held at midsection 14. This also provides sufficient firmness so that an item, object, baby or the like is supported without significant deflection or indentation of pillow body 12. Use of center seam 28 is also useful in that it helps the pillow body return to the shape shown in FIG. 1 if ends 20 and 22 are separated. For instance, if pillow 10 is placed around a larger individual, ends 20 and 22 may be pulled further apart. When released, seam 28 causes ends 20 and 22 to spring back to its original position. After stuffing the fill material within cover 26, the cover 26 may be closed by creating an exterior seam line 29. However, other techniques could be used as well. For example, a zipper could be used in place of an exterior seam.

It will be appreciated that various other techniques may be used to construct pillow 10. Merely be way of example, pillow 10 may be constructed using techniques similar to those described in U.S. Pat. Nos. 5,261,134; 5,661,861; 6,038,720; 6,055,687; 6,434,770; 6,352,612; 6,279,185; 6,412,128; 6,453,493; and 6,523,200; and in copending U.S.

application Ser. Nos. 10/046,377, filed Oct. 26, 2001, Ser. No. 09,884,742, filed Jun. 18, 2001, Ser. No. 09/679,139, filed Oct. 3, 2000, Ser. No. 09/802,097, filed Mar. 8, 2001, Ser. No. 10/426,067, filed Apr. 28, 2003, and Ser. No. 10/612,267, filed on the same date as the present application (entitled "Support Pillow for Small Infants", attorney docket No. 17242-011000). The complete disclosures of all these references are herein incorporated by reference.

Pillow 10 may have an average radius of curvature that permits it to conform to the shape of a person's torso while still having its ends separated enough so that it may fit around individuals of various sizes. The radius of curvature may be in the range from about 6 inches to about 16 inches, and more preferably from about 9 inches to about 11 inches. This may permit ends 20 and 22 to be separated by a distance in the range from about 14 inches to about 28 inches without stretching ends 20 and 22 apart. If pulled apart, the ends may separate several inches further. The distance from end 20 to end 22 through midsection 14 may be in the range from about 21 inches to about 42 inches, and more preferably from about 28 inches to about 36 inches. The distance from ends 20 and 22 to the inside of midsection 14 may be in the range from about 5 inches to about 11 inches, and more preferably from about 6 inches to about 7 inches. End sections 16 and 18 may have a length in the range from about 7 inches to about 15 inches, and more preferably from about 11 inches to about 13 inches. End sections 16 and 18 may also taper toward ends 20 and 22. The amount of taper may be in the range from about 10 inches to about 6 inches, and more preferably from about 8 inches to about 7 inches, near midsection 14 and taper to about 8 inches to about 3 inches, and more preferably from about 5 inches to about 4 inches, at ends 20 and 22. The height of midsection 14 may be in the range of about 9 inches to about 4 inches, and more preferably from about 7 inches to about 5 inches. This height may lessen along end sections 16 and 18 so that the height at ends 20 and 22 may be in the range from about 5 inches to about 1 inch, and more preferably about 3 inches. Midsection 14 may have a width in the range from about 10 inches to about 5 inches and more preferably from about 7 inches to about 8 inches, and a length in the range from about 12 inches to about 24 inches and more preferably from about 16 inches to about 20 inches.

Such dimensions permit pillow 10 to be used with children, teenagers and adults of various sizes. For example, when sitting down, inner side 30 would generally conform to the user's stomach and wrap around her sides. End sections 16 and 18 taper to permit them to fit between the arms of a chair and the user's side. Pillow 10 also has a height that permits a baby to sit on the pillow while breast feeding and to be positioned at an optimal height. A user's arms or elbows may also rest on pillow 10 to hold an item at about eye level. By having ends 20 and 22 wrap around the user's side, it facilitates supporting of the user's arms or elbows.

As shown in FIGS. 3*a* and 3*b*, a removable slip cover 40 may be placed over cover 26. Slip cover 40 may be constructed of a wide variety of fabrics, including any of those used for cover 26. Slip cover 40 may be configured to tightly conform to the shape of pillow 10 and may have one or more openings and one or more fasteners to permit pillow 10 to be inserted into cover 40 and then close cover 40. Cover 40 may also be used if pillow 10 is inflatable. Suitable types of slip covers are also described in U.S. Pat. No. 6,453,493 incorporated herein by reference.

Although not shown, it will be appreciated that other features may be added to pillow 10. For example, various toys or other items may be attached to or surrounded above pillow 10 as described in any of the references incorporated herein. Also a strap may extend between ends 20 and 22 to help hold pillow 10 about a user. As other examples, one or more pockets or other attachment members (such as straps) may be attached to pillow 10 to hold a variety of items, such as described in the references incorporated herein. As some specific examples, the pockets may be used to hold bottles, toys, burping cloths, and the like. Pillow 10 may also have one or more handles to help transport the pillow. Such handles may be similar to those described in references incorporated herein. Still further, pillow 10 may have a head member (such as an animal head) attached anywhere along the pillow, such as at one end. Examples of such head members are described in the references incorporated herein.

Pillow 10 may be packaged and stored using a variety of packing devices, purses or the like. Examples of such packages and bags are described in references incorporated herein and in copending U.S. application Ser. No. 09/884,742, filed Jun. 18, 2001, and Ser. No. 10/612,265, filed on the same date as the present application (entitled "Diaper Bag and Carrying Device", attorney docket No. 017242-010800U.S.), incorporated herein by reference. Pillow 10 may also be displayed using any of the techniques or devices described in U.S. Pat. No. 6,119,873 incorporated herein by reference.

Figure 4:
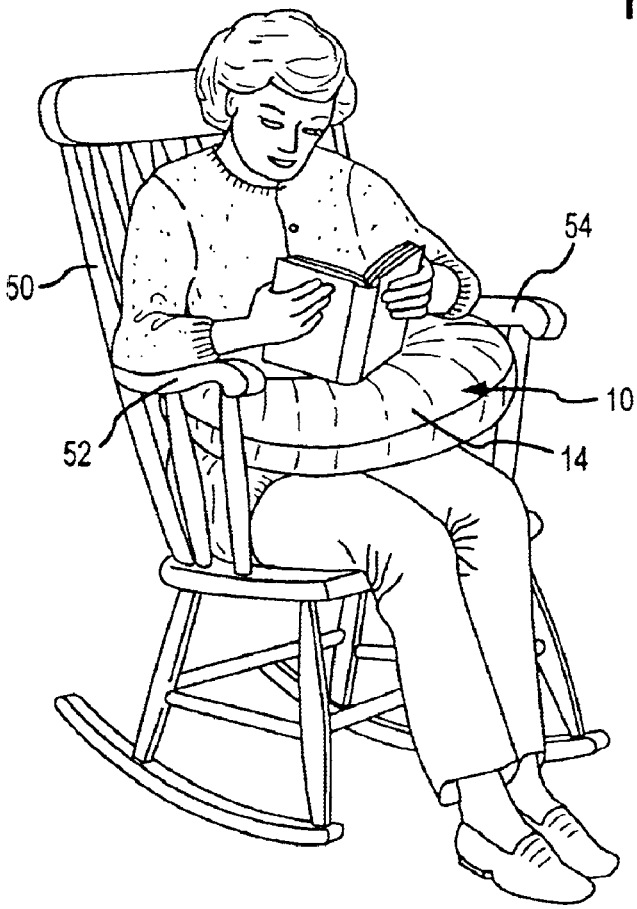
FIG. 4 illustrates the pillow of FIG. 1 when held in a user's lap according to the invention.

Referring now to FIG. 4, pillow 10 is shown resting on the lap of a user. The user is sitting in a chair 50 having a pair of arms 52 and 54. In this position, midsection 14 rests on the user's lap while end sections 16 and 18 wrap around the user's sides. Ends 20 and 22 fit between arms 52 and 54. In this way, a book or the user's elbows may rest on pillow 10. As another alternative, a baby may rest on pillow 10 while being fed or nursed. Examples of chairs having such arms include rocking chairs, wheel chairs, end chairs and the like. Other items that may be held include food, crafts, knitting, games, computers, phones and the like.

Further, it will be appreciated that a variety of other uses for pillow 10 exist. These may include, for example, as a back support, as a traditional pillow for the head, to prop up a baby or child, as a seat cushion or the like. As another example, the pillow may be used to support the legs or hips. For example, when a person is lying on his or her back, the pillow may be placed between the user's legs or knees and the ground. This permit's the person's legs to be propped up. As a further example, the pillow may be placed between the person's legs or knees while the person is lying on his or her side. As still another example, the pillow may be used as a back or front support when the person is lying on his or her side. For instance, for a pregnant woman, the pillow could be placed between the mother's stomach and the ground to help support the stomach. Other examples of how such a pillow may be used are described in any of the references incorporated herein.

The invention has now been described in detail for purposes of clarity and understanding. However it will be appreciated that certain changes and modifications may be practiced within the scope of the appended claims.

What is claimed is:

1. A pillow comprising:

a pillow body having a midsection and a pair of ends, wherein the pillow body is curved and has an average radius of curvature in the range from about 6 inches to about 16 inches, wherein the ends are spaced apart from each other in the range from about 14 inches to about 28 inches without being stretched apart, and wherein the pillow body is both firm and flexible to permit the pillow body to be wrapped about a user.

2. A pillow as in claim 1, wherein the pillow body comprises a fill material that is stuffed within an outer cover.

3. A pillow as in claim 2, wherein the fill material comprises polyester fibers, and wherein the outer cover comprises a cotton fabric.

4. A pillow as in claim 1, wherein the ends of the pillow body are rounded.

5. A pillow as n claim 1, wherein the midsection of the pillow body has an average width in the range from about 5 inches to about 10 inches and an average height in the range from about 4 inches to about 9 inches.

6. A pillow as in claim 1, wherein the ends have an average width in the range from about 3 inches to about 10 inches and an average height in the range from about 1 inch to about 9 inches.

7. A pillow as in claim 1, wherein the pillow has a length from one end to the other end in the range from about 21 inches to about 42 inches.

8. A pillow as in claim 1, wherein the pillow body comprises an inflatable bladder.

9. A pillow as in claim 1, further comprising a removable slip cover that is configured to fit over and closely conform to the shape of the pillow body.

10. A pillow as in claim 9, wherein the slip cover includes an opening and a fastener to close the opening.

11. A method for supporting an item, comprising:

providing a pillow comprising a pillow body having a midsection and a pair of ends, wherein the pillow body is curved and has an average radius of curvature in the range from about 6 inches to about 16 inches, wherein the ends are spaced apart from each other in the range from about 14 inches to about 28 inches without stretching the arms, and wherein the pillow body is both firm and flexible to permit the pillow body to be wrapped about a user;

placing the pillow onto a lap of a user who is sitting down, with the midsection being adjacent the user's stomach and with the ends extending around the user's sides; and supporting an item using the pillow.

12. A method as in claim 11, wherein the item comprises a baby, and further comprising feeding the baby while being supported by the pillow.

13. A method as in claim 12, further comprising nursing the baby while being supported by the pillow.

14. A method as in claim 11, wherein the item comprises a book, and further comprising reading the book.

15. A method as in claim 11, wherein the user is sitting in a chair having a pair of arms, and further comprising adjusting the pillow so that the ends are positioned between the arms of the chair and the user's sides.

16. A method as in claim 11, wherein the pillow body comprises a fill material that is stuffed within an outer cover.

17. A method as in claim 16, wherein the fill material comprises polyester fibers, and wherein the outer cover comprises a cotton fabric.

18. A method as in claim 11, wherein the ends of the pillow body are rounded.

19. A method as in claim 11, wherein the midsection of the pillow body has an average width in the range from about 5 inches to about 10 inches and an average height in the range from about 4 inches to about 9 inches.

20. A method as in claim 11, wherein the ends have an average width in the range from about 3 inches to about 10 inches and an average height in the range from about 1 inch to about 9 inches.

21. A method as in claim 11, wherein the pillow has a length from one end to the other end in the range from about 21 inches to about 42 inches.

22. A method as in claim 11, wherein the pillow body comprises an inflatable bladder, and further comprising inflating the bladder.

23. A method as in claim 11, further comprising a removable slip cover that is configured to fit over and closely conform to the shape of the pillow body, and further comprising placing the slip cover over the pillow body.

* * * * *